US006974189B2

(12) United States Patent
Machael et al.

(10) Patent No.: US 6,974,189 B2
(45) Date of Patent: Dec. 13, 2005

(54) VERTICALLY ADJUSTABLE CHAIR ARMREST

(75) Inventors: Jay R. Machael, Muscatine, IA (US); Marcus C. Koepke, Indianapolis, IN (US); Brian R. Trego, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/749,010

(22) Filed: Dec. 30, 2003

(65) Prior Publication Data

US 2005/0146191 A1 Jul. 7, 2005

(51) Int. Cl.[7] ..... A47C 7/54
(52) U.S. Cl. ..... 297/411.36; 297/411.35
(58) Field of Search ..... 297/411.35, 411.36, 297/411.37

(56) References Cited

U.S. PATENT DOCUMENTS

| | | | | |
|---|---|---|---|---|
| 251,069 | A | 12/1881 | Shaw | |
| 2,549,902 | A * | 4/1951 | Hibbard et al. | 297/284.3 |
| 5,324,096 | A | 6/1994 | Schultz | |
| 5,667,277 | A * | 9/1997 | Van De Riet | 297/411.36 |
| 5,853,223 | A | 12/1998 | Ritt et al. | |
| 5,876,097 | A * | 3/1999 | Cao | 297/411.37 |
| 6,050,634 | A * | 4/2000 | Yamagishi et al. | 297/115 |
| 6,168,237 | B1 * | 1/2001 | Lamart et al. | 297/411.37 |
| 6,209,961 | B1 * | 4/2001 | Chen | 297/411.36 |
| 6,315,362 | B1 * | 11/2001 | Chuang | 297/411.36 |
| 6,336,680 | B1 * | 1/2002 | Lee | 297/411.36 |
| 6,394,553 | B1 * | 5/2002 | McAllister et al. | 297/411.36 |
| 6,398,309 | B1 | 6/2002 | Chen | |
| 6,419,323 | B1 * | 7/2002 | Chu et al. | 297/411.36 |
| 6,619,746 | B2 * | 9/2003 | Roslund et al. | 297/411.36 |
| 6,761,410 | B2 * | 7/2004 | Lee | 297/411.36 |
| 6,811,224 | B2 * | 11/2004 | Roney et al. | 297/411.35 |

FOREIGN PATENT DOCUMENTS

| | | |
|---|---|---|
| DE | 20108247 | 7/2002 |
| EP | 1258209 | 11/2002 |

* cited by examiner

*Primary Examiner*—Peter M. Cuomo
*Assistant Examiner*—Stephen D'Adamo
(74) *Attorney, Agent, or Firm*—Ronald A. Sandler; Jones Day

(57) ABSTRACT

A vertically adjustable armrest assembly having a support, a plate fitted to an interior of said support, the plate having a series of vertically aligned openings, a slide having an armrest at a top end portion, and a lateral slot for guiding a block into and out of selective aligned openings in the plate. A rod having a saw tooth portion complementing a slanted opening in the block allows manipulation of the rod to selectively move the block into and out of the plate openings.

31 Claims, 11 Drawing Sheets

VERTICALLY ADJUSTABLE CHAIR ARMREST

BACKGROUND OF THE INVENTION

Cross Reference To Priority Applications

Not applicable.

STATEMENT REGARDING FEDERALLY SPONSORED RESEARCH

Not applicable.

1. Field of the Invention

The present invention relates to a vertically adjustable armrest for a chair and more particularly, to a vertically adjustable armrest for an office chair, the armrest being capable of easily and precisely adjusting upwardly and downwardly while being simply constructed and relatively inexpensive.

2. Description of the Related Art

Most modern office chair armrests are vertically adjustable. See, for example, several patents: U.S. Pat. Nos. 6,398,309 ; 5,853,223 ; 5,324,096; and EP 1258209. While these patents disclose adjustable armrests, the armrest mechanism may be unreliable, difficult to use and/or relatively expensive.

BRIEF SUMMARY OF THE INVENTION

The objectives encountered with previous devices have been overcome by the present invention. What is described here is a vertically adjustable armrest assembly for a chair comprising a support connected to the chair and extending generally in a vertical direction, the support having an open top, a plate connected to the interior wall of the support, the plate having a series of vertically aligned openings, and a slide element for supporting an armrest, the slide element being disposed within the support and extending out of the open top, and being positioned adjacent the plate, and having a lateral opening. The armrest assembly also includes a laterally movable block for being selectively received in the openings of the plate, a rod extending generally parallel to the slide element, the rod having a handle at an upper portion thereof and a misaligned portion, the misaligned portion operatively connected to the block for selectively moving the block into and out of openings in the plate, and a biasing element connected to the rod for maintaining the rod in a predetermined position.

There are number of advantages, features and objects achieved with the present invention which are believed not to be available in earlier related devices. For example, two advantages of the present adjustable armrest invention are that the adjustable armrest is simply constructed and relatively inexpensive. Two other features of the present armrest invention are that the armrest is reliably operated, easy to use and very robust. Other objects of the present invention are the provision of an armrest which is easily and quickly assembled and thereby is cost effective.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112 (first paragraph), but the invention itself is defined by the attached claims.

DETAILED DESCRIPTION OF A PREFERRED EMBODIMENT OF THE INVENTION

Figure 1:
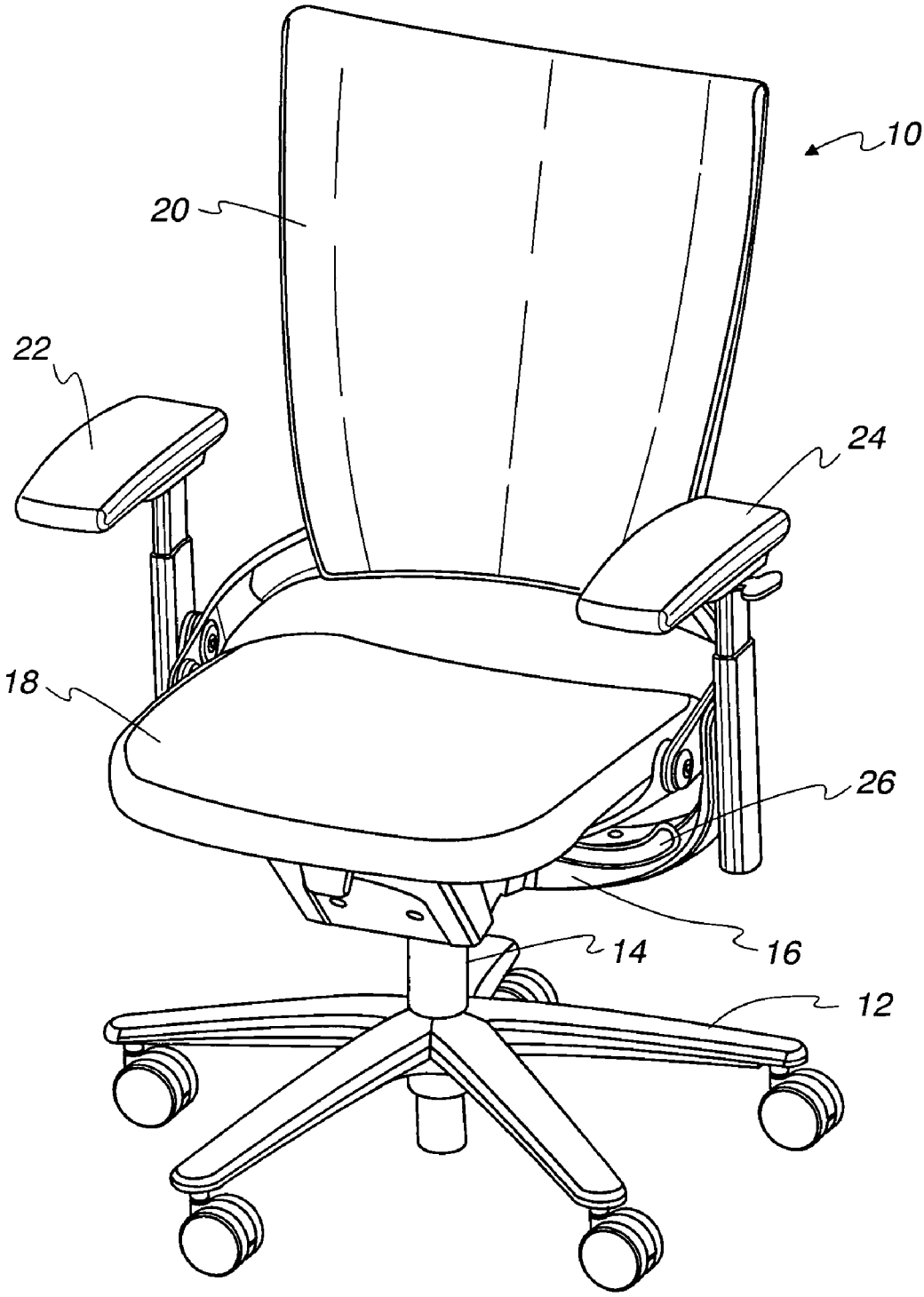
FIG. 1 is an isometric view of an office chair with vertically adjustable armrests.

While the present invention is open to various modifications and alternative constructions, the preferred embodiment shown in the various figures of the drawing will be described herein in detail. It is understood, however, that there is no intention to limit the invention to the particular embodiment, form or example which is disclosed here. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Referring now to FIG. 1, there is shown an office chair 10 having adjustable armrests. The chair includes a base 12, a pedestal 14, a frame assembly 16, a seat assembly 18, a back assembly 20, a pair of adjustable armrests 22, 24 and control levers, such as control lever 26.

Figure 2:
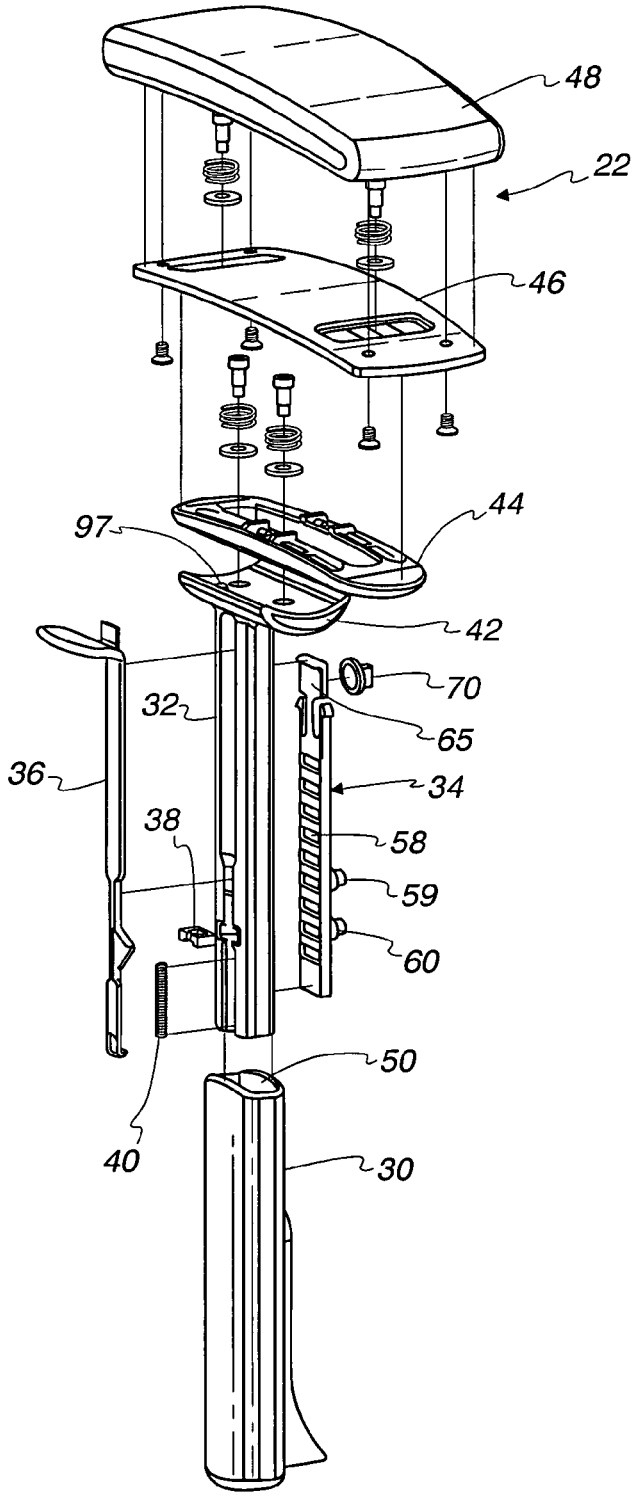
FIG. 2 is an exploded isometric view of one of the vertically adjustable armrest assemblies.
Figure 3:
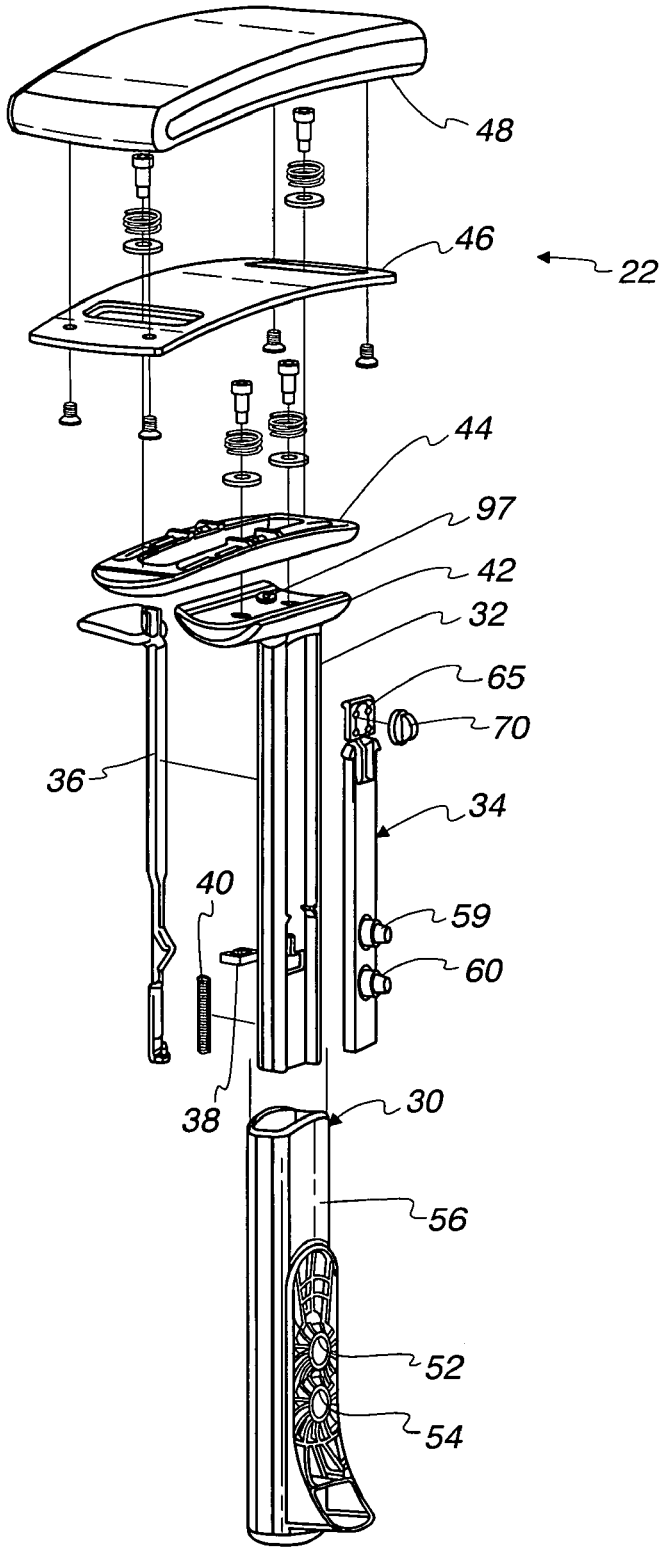
FIG. 3 is another exploded isometric view of the armrest assembly shown in FIG. 2 rotated about 90 degrees.
Figure 4:
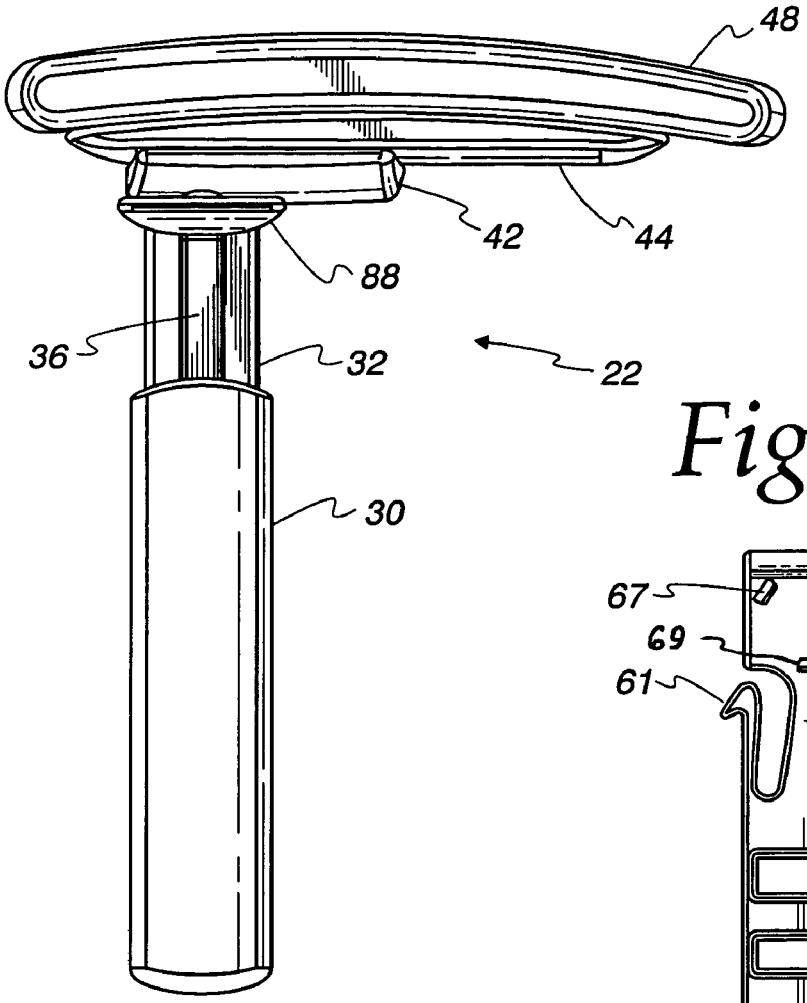
FIG. 4 is a front elevation view of an armrest assembly.
Figure 5:
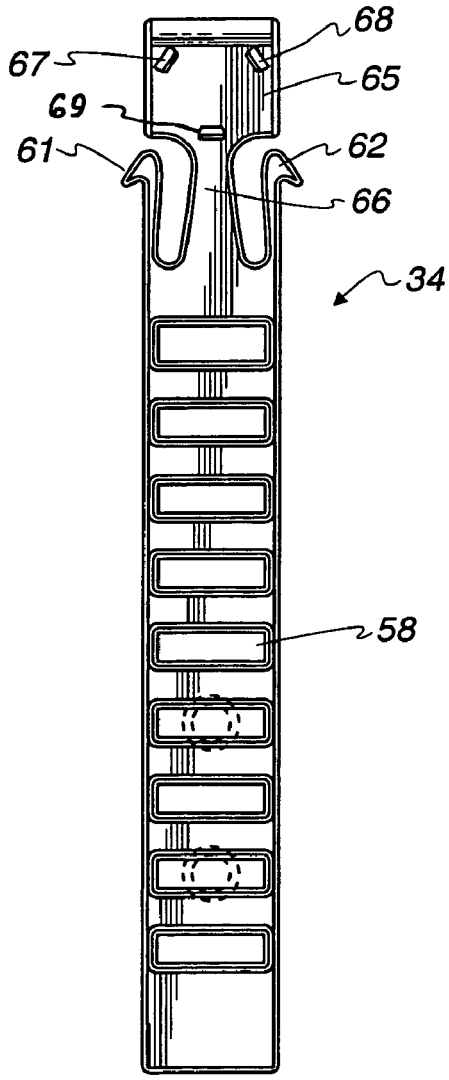
FIG. 5 is a front elevation view of a notched plate.
Figure 6:
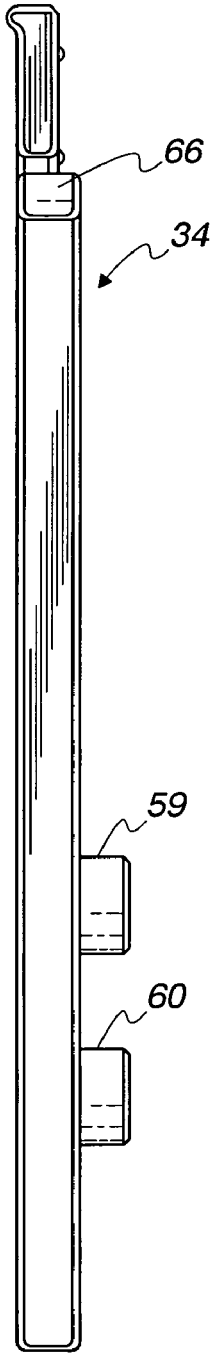
FIG. 6 is a side elevation view of the notched plate.
Figure 7:
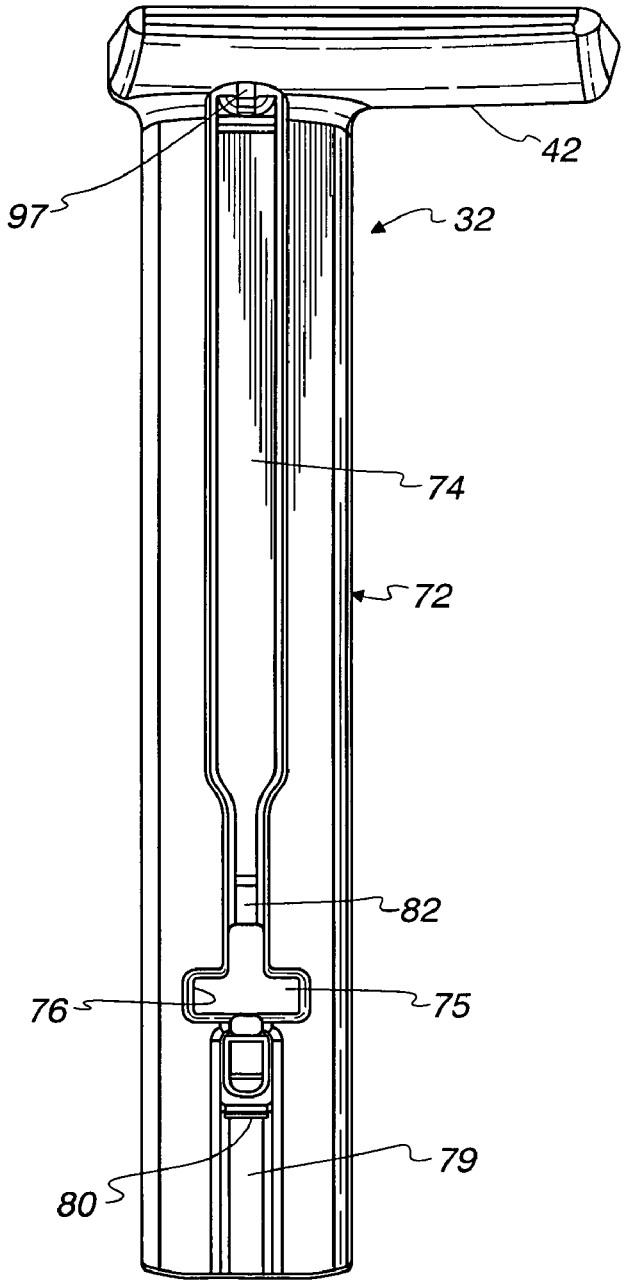
FIG. 7 is a front elevation view of a slide element.

The simplicity of the adjustable armrest may be appreciated by referring to FIGS. 2–4. The armrest assembly 22 includes a support tube 30 connected to the frame assembly 16, a vertical adjustment slide 32, a notched plate 34, an operating rod 36, a lock block 38 and a spring 40. The vertical adjustment slide 32 acts as a mounting member and is formed with an upper base 42. Slidably mounted to the upper base 42 is a lower slide element 44, slidably mounted to the lower slide element 44 is an upper slide element 46, and attached to the upper slide element 46 is an armrest cover 48.

Reference is made to co-pending patent applications assigned to the same assignee as the present application and entitled Horizontally Adjustable Chair Armrest, application Ser. No. 10/748,537, filed Dec. 30, 2003; Chair with Backward and Forward Passive Tilt Capabilities, application Ser.

No. 10/749,008, filed Dec. 30, 2003; Chair Back, application Ser. No. 10/750,573, filed Dec. 30, 2003; Chair with Adjustable Seat Back, application Ser. No. 10/748,079, filed Dec. 30, 2003; and Tilt Lock Mechanism, application Ser. No. 10/749,009, filed Dec. 30, 2003. These applications disclose other features of the chair. This disclosure here, and the disclosure Horizontally Adjustable Chair Armrest illustrate the range of movement of the armrests. All disclosure of the Applications just mentioned are incorporated herein by reference. It is to be appreciate that a chair armrest may be fixed vertically and only adjustable horizontally, or fixed horizontally and adjustable vertically, or the vertical adjustment assembly disclosed here may be used with a horizontal adjustment assembly different from that disclosed in application Ser. No. 10/748,537.

The support tube 30 includes an open top 50 and two lateral openings 52, 54 in one of the side walls 56 and the tube receives the vertically adjustable slide 32 and the stationary notched plate 34.

Figure 8:
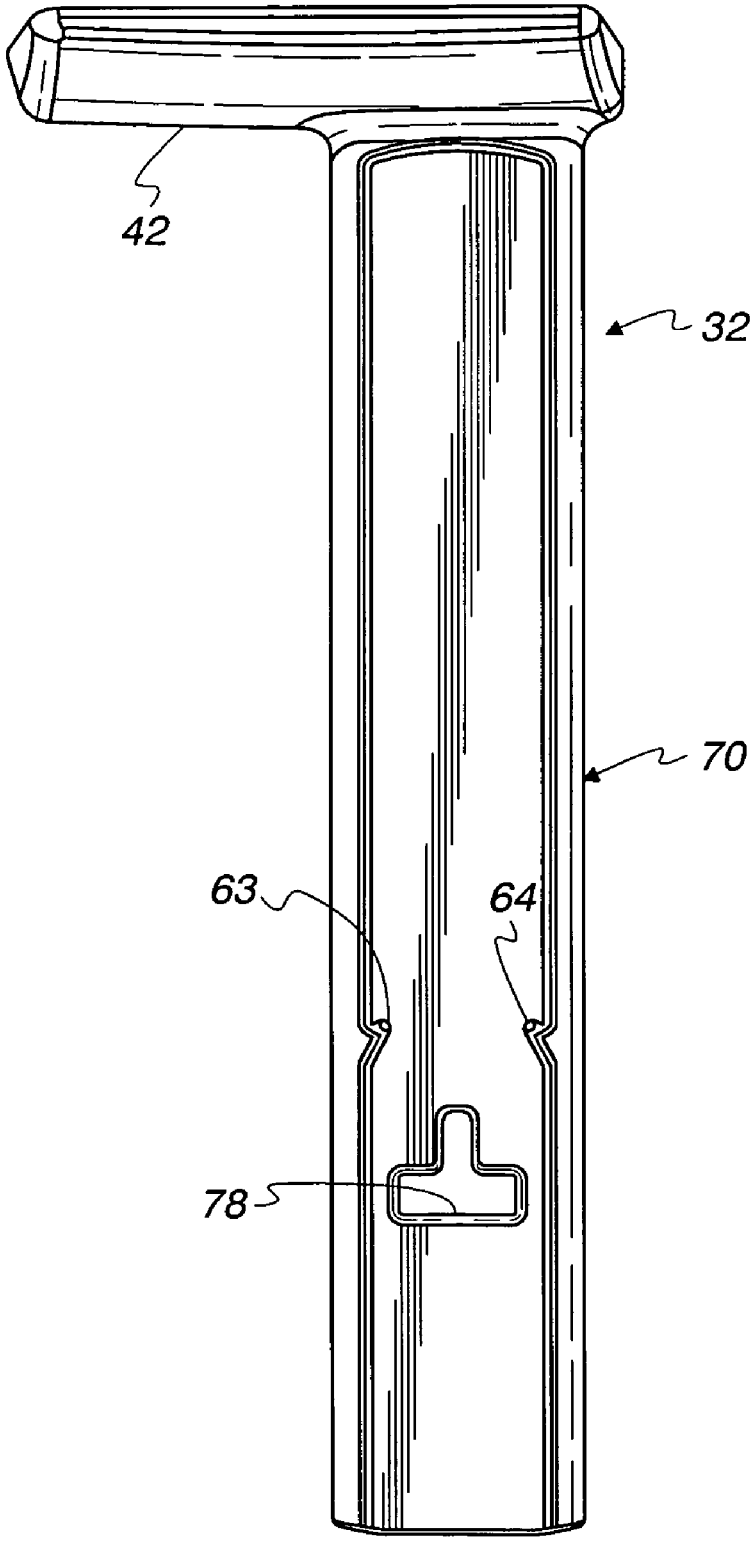
FIG. 8 is a rear elevation view of the slide element.
Figure 9:
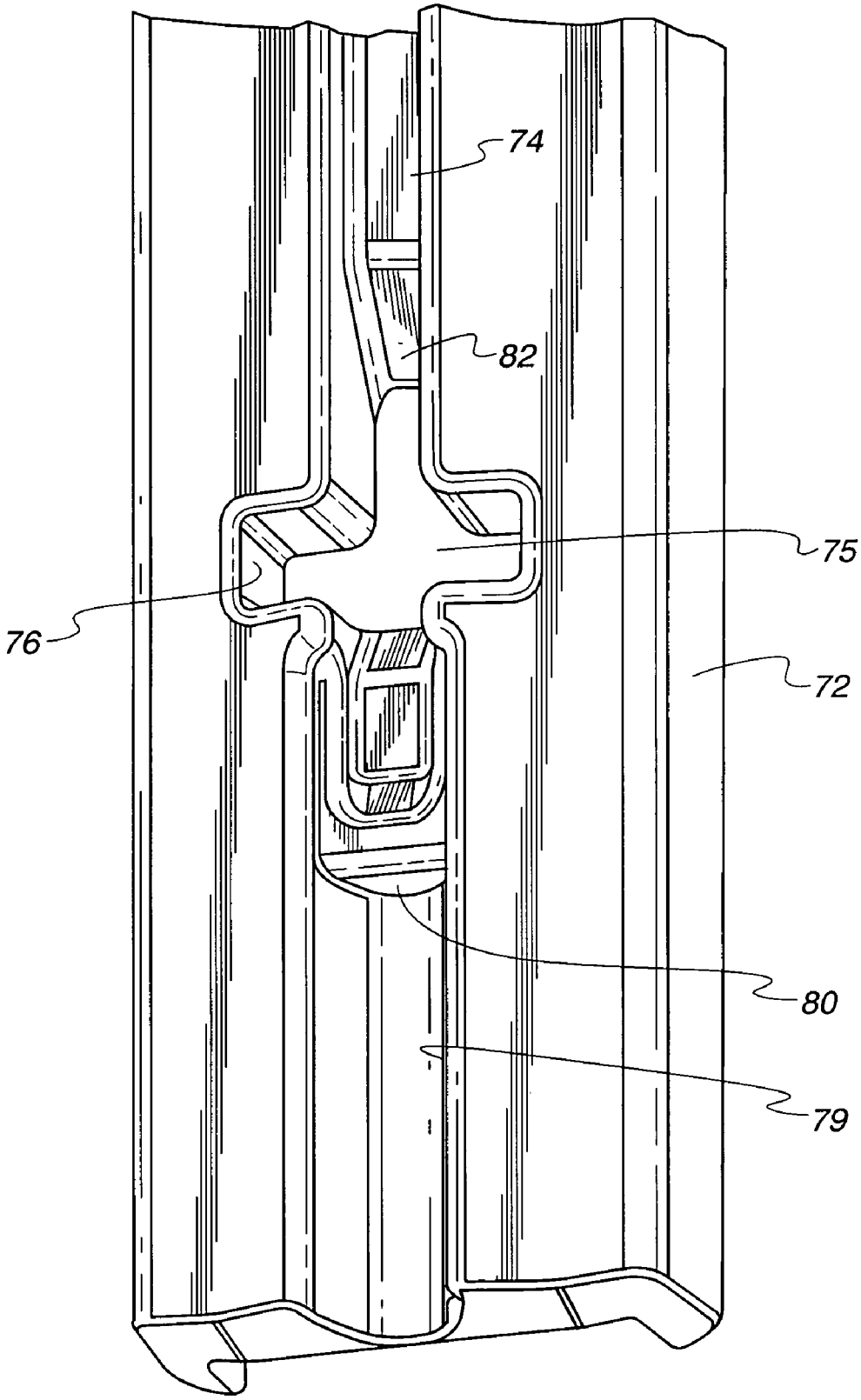
FIG. 9 is an enlarged front isometric view of a portion of the slide element.
Figure 10:
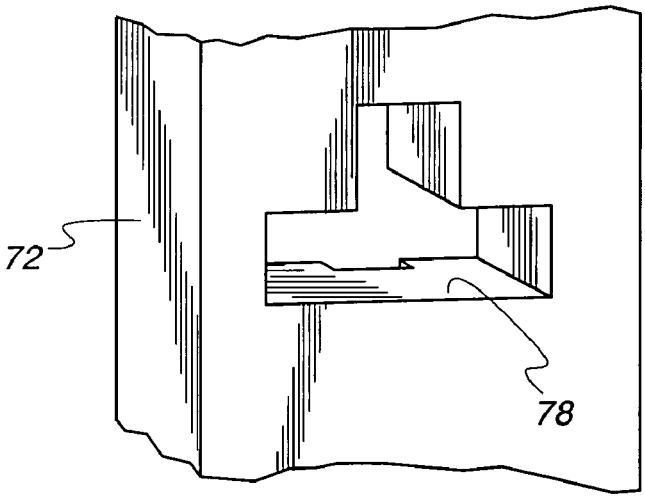
FIG. 10 is a rear isometric view of the portion of the slide element shown in FIG. 8.

The notched plate 34, FIGS. 2, 3, 5 and 6, includes a plurality of aligned openings or notches, such as the opening 58. The notched plate 34 also includes two cylindrical posts 59, 60 which are received by the lateral openings 52, 54 in the wall of the support tube. Fasteners, not shown, attach the support tube and notched plate to the frame assembly 16 by extending into the posts. The notched plate 34 also includes two wing tabs 61, 62 for limiting vertical movement of the slide 32 by engaging tabs 63, 64, FIG. 8, on the slide 32. At the upper portion of the notched plate is a head portion 65 integral with the remainder of the plate by a thin neck portion 66. Three small guides 67, 68, 69 are formed on the head portion. A spring 70 is retained by the small guides and when assembled has one end bearing against the wall 56 of the support tube 30 and the other end bearing against the head portion 65. The thin neck portion provides flexibility to the head portion 65 and allows the head portion to press against the adjustable slide 32. This arrangement provides a tighter and consistent feel to the armrest and offers compensation for variations in manufacturing tolerances.

The adjustment slide 32 includes a longitudinally extending stem 72, FIGS. 7–10, and the upper base 42. The stem 72 includes an elongated upper slot 74 and a lateral opening 75 having a cross shaped front 76 and an inverted "T" shaped rear 78. The stem 72 also includes a lower slot 79, a spring retainer lateral wall 80 and a slanted abutment wall 82. The elongated upper slot 74 and the cross shaped lateral opening 75 are structured to receive and guide the rod 36 which moves vertically in the upper slot. The support tube 30 acts as a guide for the adjustable slide 32, and the lateral opening 75 acts as a guide for the block 38.

Figure 11:
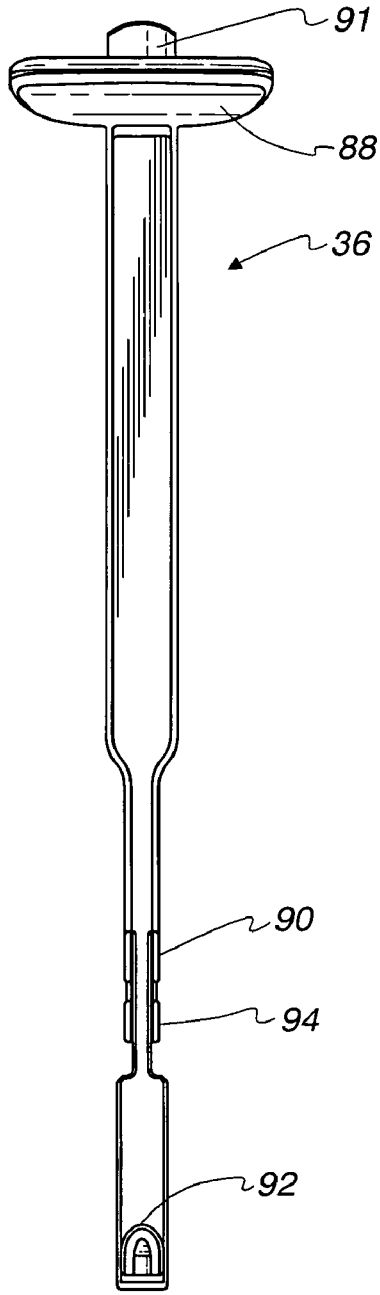
FIG. 11 is a front elevation view of an operating rod.
Figure 12:
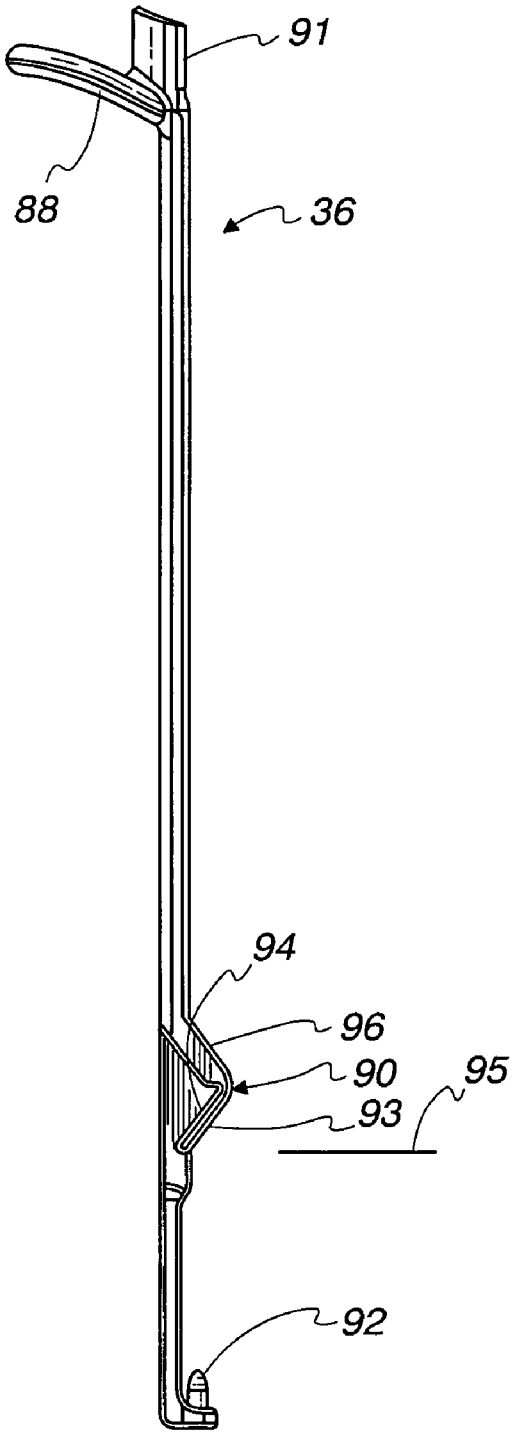
FIG. 12 is a side elevation view of the operating rod.
Figure 13:
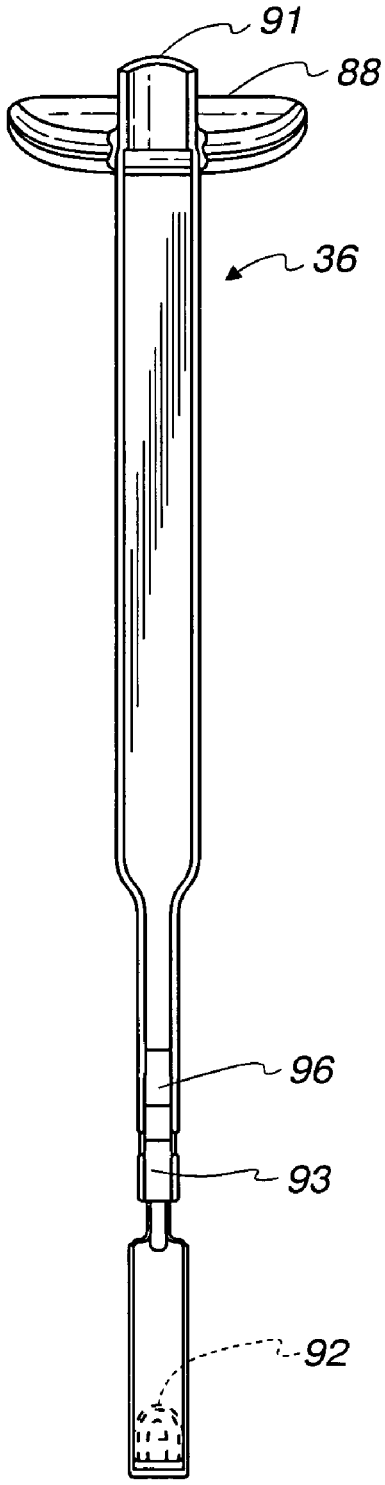
FIG. 13 is a rear elevation view of the operating rod.

The operating rod 36, FIGS. 11–13, is an elongated element having an upper handle 88 and a lower misaligned or triangular portion 90 having a "T" shaped cross section. The rod also includes an upper guide head portion 91 and a bottom projection 92 for mounting the spring 40. The handle 88 allows a user of the chair to move the rod against the spring 40, which is trapped between the projection 92 of the rod 36 and the lateral wall 80 of the slide 32. The triangular portion includes a front cam surface 93 and a rear cam surface 94. These surfaces are slanted at about fifty four degrees from a horizontal reference line 95. The rod also includes an abutment surface 96. The upper guide head portion 91 is received by an opening 97, FIG. 2, in the upper base 42.

Figure 14:
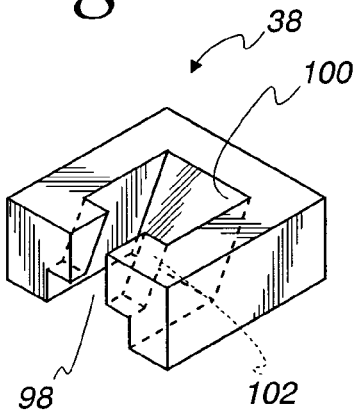
FIG. 14 is an enlarged isometric view of a block.
Figure 15:
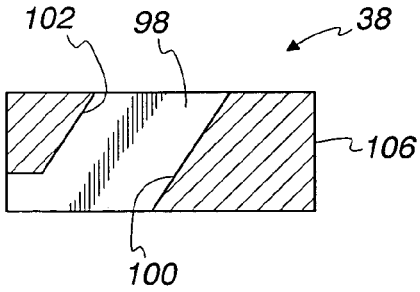
FIG. 15 is a sectional elevation view of the block.

Slidably mounted within the lateral opening 75 of the slide 32 is the horizontally movable block 38. The block includes an opening 98, FIGS. 14 and 15, through which the rod 36 extends. Engaging the cam surfaces 93, 94 of the rod 36 are internal front surface 100 and internal rear surface 102 of the block 38. These surfaces are cam followers. The block also includes a nose portion 106 which is selectively received by the notches in the notched plate 34.

Figure 16:
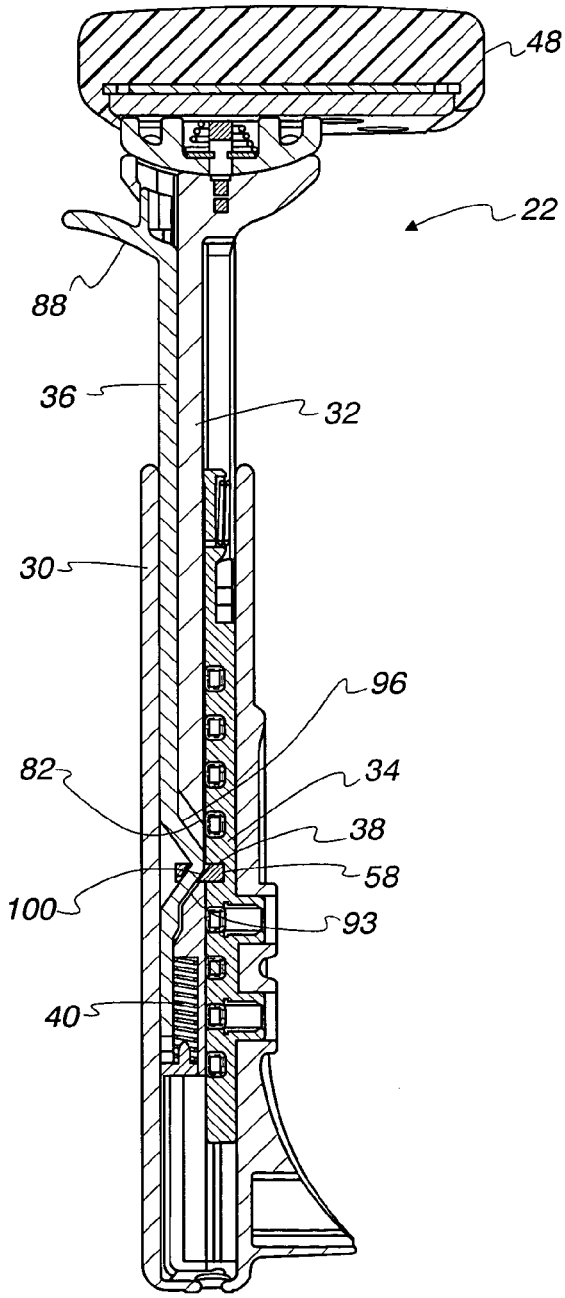
FIG. 16 is a sectional elevation view of the armrest in a locked position.
Figure 17:
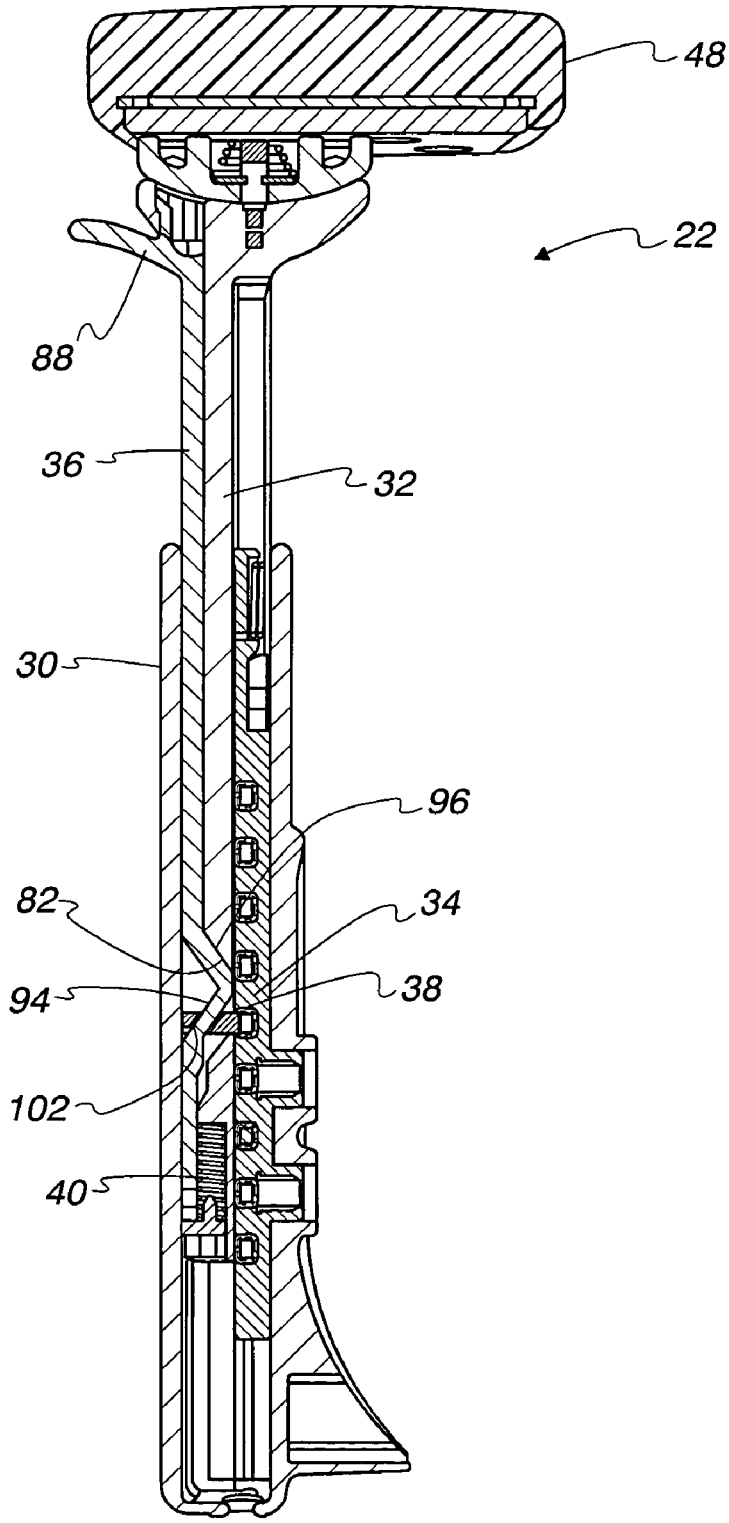
FIG. 17 is a sectional elevation view of the armrest in an unlocked position.

Referring now to FIGS. 16 and 17, the block 38 is shown in the opening 58 of the notched plate 34 in FIG. 16. When the block is inserted in one of the plate openings, the armrest is in a locked position. When the block is moved out of one of the openings, as shown in FIG. 17, then the armrest may be vertically adjusted.

Moving the block 38 horizontally into and out of the notched plate openings is accomplished by moving the rod 36 in a vertical direction by the rod handle 88. When in a locked condition, the front cam surface 93 of the rod bears against the front cam follower surface 100 of the block. When the rod is raised (FIG. 17), the spring 40 is compressed and the rear cam surface 94 of the rod bears against the rear cam follower surface 102 of the block and slides the block away from the notched plate 34 so as to disengage the block from the plate openings.

In this manner, the adjustment slide 32 is free to move vertically and the armrest may be vertically adjusted by lifting or depressing the armrest cover. Once a new vertical height is satisfactorily achieved, a chair user merely releases the rod handle 88. The spring 40 expands and causes the rod to cam or push the block back into engagement with the appropriate notched plate opening. More specifically, the front cam surface 93 of the rod bears against and pushes on the front cam follower surface 100 of the block. Even though these surfaces are slanted, it is well understood that a horizontal component of force will move the block horizontally. The abutment surface 82 of the slide limits the upward movement of the rod 36 because the abutment surface 96 of the rod 36 cannot go any higher than the abutment surface 82 of the slide 32.

The vertically adjustable armrest is easily and quickly assembled. The notched plate is aligned in the support. The rod may be placed within the opening of the block, the spring is mounted to the rod and then the rod is aligned with the vertical upper slot of the adjustment slide and the block with the lateral opening. Thereafter, the slide, the rod and the block assembly is inserted into the support tube.

In operation, a chair user sitting on the seat assembly of the office chair may easily adjust the vertical locations of the armrests simply by lifting upwardly on the rod handle against the compressing spring. This disengages the block from the opening in the notched plate and then the armrest may be moved to the desired vertical position. Thereafter, the handle is released causing the spring to bias the rod against the block thereby pushing the block back into engagement with the appropriate opening in the plate. Once engagement is achieved, the armrest is locked in the desired vertical position.

It can now be appreciated that the adjustable armrest is simply constructed, easy to use, reliable and cost effective. The adjustable armrest is relatively inexpensive and may be easily and quickly assembled.

The above specification describes in detail a preferred embodiment of the present invention. Other examples, embodiments, modifications and variations will, under both the literal claim language and the doctrine of equivalents, come within the scope of the invention defined by the appended claims. For example, making modifications to the rod and the shape of the opening in the block will still result in an equivalent structure and will also come within the literal language of the claims. The same holds true for the lateral opening in the slide. Still other alternatives will also be equivalent as will many new technologies. There is no desire or intention here to limit in any way the application of the doctrine of equivalents nor to limit or restrict the scope of the invention.

What is claimed is:

1. A vertically adjustable armrest assembly for a chair comprising:

a support connected to said chair and extending generally in a vertical direction, said support having an open top;

a structure connected to the support having a series of vertically aligned openings;

a slide element for supporting an armrest disposed within said support and extending out of said open top thereof, said slide element positioned adjacent said structure with the openings, and said slide having a lateral opening;

a horizontally movable block positioned in said slide element lateral opening, said block for being received selectively in said openings of said structure said block includes an opening and first and second surfaces, said opening formed through said block by said first and second surface;

a rod extending generally parallel to said slide element, said rod having a handle portion and an engagement portion, said engagement portion having first and second surfaces, said first surface of said engagement portion for engaging said first surface of said block for moving said block into an opening of said structure having a series of openings and said second surface of said engagement portion for engaging said second surface of said block for moving said block out of an opening of said structure having a series of openings; and a biasing element connected to said rod for biasing said rod to a predetermined position.

2. The vertically adjustable armrest of claim 1 wherein:

said slide element includes a longitudinal slot for guiding said rod.

3. The vertically adjustable armrest of claim 1 wherein:

said lateral opening of said slide is a guide for said block when said block moves into and out of one of said series of aligned openings in said structure.

4. The vertically adjustable armrest of claim 1 wherein:

said biasing element is a spring located between said rod and said slide element.

5. The vertically adjustable armrest of claim 1 wherein:

said support engages and guides said slide element.

6. The vertically adjustable armrest of claim 1 wherein:

said slide element includes an upper generally horizontal base with an opening; and said rod includes an upper arm for riding in said opening of said upper base.

7. The vertically adjustable armrest of claim 1 wherein:

said structure is a plate;

said plate includes a cylindrical projection; and said support includes an opening for receiving said cylindrical projection.

8. The vertically adjustable armrest of claim 1 wherein:

said block includes an opening formed by said first and second surfaces; and said rod engaging said first surface of said block when moved in a first direction and engaging said second surface of said block when moved in a second direction.

9. The vertically adjustable armrest of claim 8 wherein:

said first surface of said block is oppositely disposed from said second surface of said block.

10. The vertically adjustable armrest of claim 9 wherein:

said first and said second surfaces of said block are slanted and parallel to each other.

11. The vertically adjustably armrest of claim 1 wherein:

said rod engaging said first surface of said block when moved downwardly and engaging said second surface of said block when moved upwardly.

12. The vertically adjustable armrest of claim 11 wherein:

said first surface of said block is oppositely disposed from said second surface of said block.

13. The vertically adjustable armrest of claim 12 wherein:

said slide element includes a longitudinal slot for guiding said rod.

14. The vertically adjustable armrest of claim 13 wherein:

said lateral opening of said slide is a guide for said block when said block moves into and out of an opening in said plate.

15. The vertically adjustable armrest of claim 14 wherein:

said support is a guide for said slide element.

16. The vertically adjustable armrest of claim 12 wherein:

said structure is a plate;

said plate includes a cylindrical projection; and said support includes an opening for receiving said cylindrical projection.

17. The vertically adjustable armrest of claim 16 wherein:

said slide includes an upper base with an opening; and said rod includes an upper arm for riding in said opening of said upper base.

18. The vertically adjustable armrest of claim 17 wherein:

said support is a guide for said slide element.

19. The vertically adjustable armrest of claim 18 wherein:

said slide element includes a longitudinal slot for guiding said rod; and said lateral opening of said slide is a guide for said block when said block moves into and out of an opening in said plate.

20. A vertically adjustable armrest assembly for a chair comprising:

a vertically movable slide element having an upper portion for mounting a horizontally adjustable armrest assembly, said slide element having an opening;

a horizontally slidable block mounted in said opening of said vertically movable slide element, said block having an opening with a first slanted surface and a second slanted surface;

an elongated rod having an operating handle and a first surface and a second surface, said first and second surfaces being mounted in said opening of said block wherein upward vertical movement of said rod causes said second surface of said rod to engage said second slanted surface of said block to move said block to an unlocking position and wherein downward vertical movement of said rod causes said first surface of said rod to engage said first slanted surface of said block to move said to a locking position;

a spring for biasing said rod to a predetermined position;

a plate having vertically aligned openings, each opening for selectively receiving said block into a locking position; and a structure for supporting said vertically movable slide element, said block, said rod, said spring and said plate.

21. The vertically adjustable armrest of claim 20 including:

first and second horizontal slide elements mounted to said upper portion of said vertically movable slide element.

22. The vertically adjustable armrest of claim 20 wherein:

said surfaces of said rod are slanted.

23. The vertically adjustable armrest of claim 20 wherein:

said spring is mounted between said rod and said vertically movable slide element.

24. The vertically adjustable armrest of claim 20 wherein:

said vertically movable slide element includes an elongated guide slot for said rod.

25. The vertically adjustable armrest of claim 20 wherein:

said vertically movable slide element includes a slot for said spring.

26. The vertically adjustable armrest of claim 20 wherein:

said opening of said vertically movable slide element has a cross shaped front.

27. The vertically adjustable armrest of claim 20 wherein:

said opening of said vertically movable slide element has an inverted "T" shaped rear.

28. The vertically adjustable armrest of claim 20 wherein:

said plate biases said slide element.

29. The vertically adjustable armrest of claim 20 wherein:

said rod includes a head portion and said slide element includes a base with an opening for receiving said head portion.

30. The vertically adjustable armrest of claim 20 wherein:

said surfaces of said rod are slanted;

said vertically movable slide element includes an elongated guide slot for said rod; and said vertically movable slide element includes a slot for said spring.

31. The vertically adjustable armrest of claim 30 wherein:

said opening of said vertically shaped slide element has a cross shaped front and an inverted "T" shaped rear.

* * * * *